US006117301A

United States Patent [19]

Freudenberger et al.

[11] Patent Number: 6,117,301

[45] Date of Patent: Sep. 12, 2000

[54] ELECTROLYTE FOR THE GALVANIC DEPOSITION OF LOW-STRESS, CRACK-RESISTANT RUTHENIUM LAYERS

[75] Inventors: Renate Freudenberger, Stuttgart; Andreas Zielonka, Schwäbisch Gmünd, both of Germany

[73] Assignee: Degussa-Hüls Aktiengesellschaft, Frankfurt, Germany

[21] Appl. No.: 09/159,235

[22] Filed: Sep. 23, 1998

[51] Int. Cl.[7] ..... C25D 3/52

[52] U.S. Cl. ..... 205/264; 260/259; 260/257; 106/1.28

[58] Field of Search ..... 205/257, 259, 205/260, 264; 106/1.28

[56] References Cited

U.S. PATENT DOCUMENTS

| | | | |
|---|---|---|---|
| 3,576,724 | 4/1971 | Reddy | 204/47 |
| 3,793,162 | 2/1974 | Hope | 204/47 |
| 4,375,392 | 3/1983 | Baker et al. | 205/264 |
| 4,673,472 | 6/1987 | Morrissey et al. | 205/265 |

FOREIGN PATENT DOCUMENTS

| | | |
|---|---|---|
| 1191435 | 5/1970 | United Kingdom . |

*Primary Examiner*—Kishor Mayekar
*Attorney, Agent, or Firm*—Smith Gambrell & Russell, LLP

[57] ABSTRACT

An electrolyte for the galvanic deposition of stress-relieved, crack-resistant ruthenium layers containing ruthenium in complexed form. The additive for the electrolyte is pyridine or an N-alkylated pyridinium salts of formula I (I)

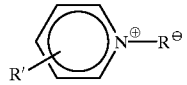

wherein $R^{\ominus}$ is $—(CH_2)_3—SO_3^{\ominus}$, $—CH_2—CHOH—CH_2—SO_3^{\ominus}$, or

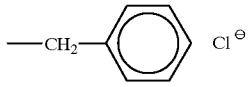

R' and H is, alkyl with 1–6 C atoms, $—CH{=}CH_2$, or $—CO_2Na$.

18 Claims, No Drawings

ELECTROLYTE FOR THE GALVANIC DEPOSITION OF LOW-STRESS, CRACK-RESISTANT RUTHENIUM LAYERS

INTRODUCTION AND BACKGROUND

The present invention relates to an electrolyte for the galvanic deposition of stress-relieved/low-stress, crack-free ruthenium layers.

In a further aspect, the present invention relates to the method of producing an electrolyte for the galvanic deposition of stress-relieved, crack resistant ruthenium layers and the use of pyridine and N-alkylated pyridinium salts for that purpose.

Galvanic ruthenium baths are based as a rule on ruthenium(III) compounds in aqueous-acidic solution. Ruthenium(III) chloride serves primarily as the ruthenium source. For a good many years ruthenium baths have been used which contain amidosulfuric acid (sulfamic acid) and/or ammonium sulfate and in which the ruthenium is present in complexed form. The ruthenium can be present therein as a complex with amidosulfuric acid, with an organic acid or in the form of the complex $[Ru_2NX_8\ (H_2O)]^{3-}$, wherein X=halogen, especially the ruthenium nitridochloro complex ("RuNC salt"). Such baths have proved that they are stable and unobjectionable and yield ruthenium coatings with good adhesion. More detailed information about the pertinent state of the art can be obtained e.g. from publications such as *Galvanotechnik* 81 (8), 2742–2744 (1990), *Chem. Ing. Tech.* 50, 296–298 (1978) as well as the patent documents DE 22 61 944 (corresponding to U.S. Pat. No. 3,793,162), DE 20 00 410 (corresponding to Great Britain 1191435), and DE 18 03 524 corresponding to U.S. Pat. No. 3,576,724, all of which are relied on and incorporated herein by reference.

Inner stresses are built up in the galvanic deposition of ruthenium layers, which increasingly occurs with increasing thickness of the deposited coating. This can lead to the formation of cracks. Therefore, dense, crack-free, well-adhering, shiny ruthenium coatings can be produced only to a thickness of approximately 2 to 3 $\mu$m with current galvanic baths and customary pretreatment techniques and deposition techniques. Inner stresses of up to 600 N/mm$^2$ can readily occur in layer thicknesses up to this order of magnitude. Previously known measures for reducing the inner stresses, e.g. by modifying the ruthenium complex, changing the electrolyte compositions, adding stress-reducing additives, varying the deposition conditions, etc. always entailed other disadvantages such as in particular a drastic lowering of the current flow.

An object of the invention therefore is to find additives which act in a stress-reducing manner in electrolytes for the galvanic deposition of ruthenium layers so that crack-free layers can be obtained, even in greater thickness. These additives, however, should not exert a negative impact on the electrolyte or on the deposition itself.

SUMMARY OF THE INVENTION

In achieving the above and other objects, one feature of the invention is the discovery that pyridine and certain pyridinium compounds can be added to the electrolytes.

It was surprisingly found that this goal is achieved if pyridine or a compound of formula I is added to an electrolyte containing ruthenium in a form complexed with amidosulfuric acid in aqueous-acidic solution:

(I)

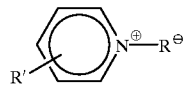

wherein $R^{\ominus}$ is a member selected from the group consisting of: $—(CH_2)_3—SO_3^{\ominus}$, $—CH_2—CHOH—CH_2—SO_3^{\ominus}$, and

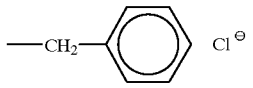

wherein R' is a member selected from the group consisting of H, alkyl with 1–6 C atoms.

$—CH{=}CH_2$, and $—CO_2Na$.

Thus, the invention provides an improved electrolyte for the galvanic deposition of ruthenium in a form completed with amidosulfuric acid which ruthenium layer is of low stress and crack-resistant and which electrolyte contains pyridine or an N-alkylated pyridinium salt of formula I as a stress-reducing additive.

Another feature of the invention resides in the use of pyridine or compounds of formula I as an additive in a method for producing electrolytes containing ruthenium in a form complexed with amidosulfuric acid for the galvanic deposition of low stress, crack-free ruthenium layers.

Preferred additives are the N-alkylated pyridinium salts of formula I. They are preferably "inner salts", known as the so-called betains.

The compounds 1-benzyl-3-sodium carboxypyridinium chloride (Ia), pyridinium-N-propyl-sulfobetain (Ib), pyridinium-N-(2-hydroxypropyl)-sulfobetain (Ic) and 2-vinylpyridinium-N-propyl-sulfobetain (Id) are especially preferred.

The amount of pyridine or compound of formula I contained in the ruthenium electrolyte in accordance with the invention can be between 0.1 g/l and 100 g/l, preferably approximately 1 g/l to 10 g/l. Preferred electrolytes in accordance with the invention contain about 2 g/l compound of formula I.

Pyridine or the compound of formula I is advantageously added to the ready base electrolyte as an additive but can also be added at any desired time during its production. In spite of the addition of the compound of formula I the electrolyte of the invention proves to be stable during storage and able to be processed in a customary manner during use.

DETAILED DESCRIPTION OF THE INVENTION

The ruthenium electrolyte of the invention is essentially based on the proven, efficient electrolyte compositions known from the state of the art. They contain ruthenium in complexed form starting as a rule with ruthenium(III) chloride, amidosulfuric acid and/or ammonium sulfamate in aqueous-acidic solution. The qualitative and quantitative composition of such electrolyte baths as well as their production are familiar to the expert in the art. Electrolyte baths and charge concentrates containing 1 to 100 g/l, preferably 5–50 g/l ruthenium are common; they can contain 1–10 g/l amidosulfuric acid and/or ammonium sulfamate per 1 g/l ruthenium. The electrolyte of the invention preferably contains ruthenium in the form of the ruthenium nitridochloro complex $[Ru_2NCl_8(H_2O)_2)]^{3-}$. To this end mixtures containing ruthenium(III) chloride, amidosulfuric acid and/or ammonium sulfamate are heated for a sufficient time, which forms the RuNC salt.

A further feature of the invention resides in the method of producing stress-relieved, crack-free ruthenium layers by galvanic deposition in which the ruthenium is deposited cathodically from an electrolyte as herein described.

The production of ruthenium layers from the electrolyte of the invention takes place in the same way as with conventional ruthenium galvanic baths. Thus, at first a charge concentrate of standardized 50 g/l ruthenium can be diluted with water to approximately 5 g/l ruthenium. It may be necessary to regulate the pH with amidosulfuric acid and/or ammonia solution to a value between 0 and 2. The deposition on an object connected as cathode, preferably provided with a thin pre-coating of gold or palladium/nickel, can take place at temperatures between 20 and 90° C., preferably between 50 and 75° C., and at current densities between 0.5 and 8 A/dm$^2$, preferably at approximately 1 A/dm$^2$. The cathode current yield thereby is customarily in a range between 60 and 80%, which is especially advantageous.

Shiny ruthenium layers which are crack-free and hard and have excellent adhesion and wear resistance are obtained with the electrolyte of the invention. The layers produced have only low inner stresses even at rather large layer thicknesses up to approximately 5 $\mu$m. They are in the range of 200 to 300 N/mm$^2$ in the normal case, which represents considerable progress compared to known ruthenium galvanic baths.

The measuring of the inner stress of a galvanic deposited ruthenium layer can take place with the aid of a measuring strip which is also in the bath during the separation and onto which ruthenium is also separated.

The characteristic measuring magnitude, the change in length of the coated measuring strip, is detected with the aid of an inductive measuring feeler and registered in the measuring device. The further signal processing and signal storage takes place in a computer with a program for the detection of measured values.

The calculation of the inner stress σ as a function of the layer thickness "t" takes place according to the following equation, which is to be used for the coating of measuring strips as specimen patterns:

$$\sigma(t) = \frac{E \cdot d \cdot x}{2 \cdot l \cdot t} (\mathrm{N/mm^2})$$

In this equation, the symbols denote the following:

σ inner stress (N/mm$^2$)

t=thickness of the layer (mm)

E=elasticity modulus of the specimen strip (N/mm$^2$)

d=strip thickness (mm)

x=change in length (mm)

1=length of the test strip (mm).

The contraction of the measuring strip corresponds to a tensile stress of the layer and the expansion to a compressive stress. According to the definition, values for tensile stresses receive a positive sign and those for compressive stresses a negative sign.

EXAMPLE 1

Charge concentrate with 50 g/l ruthenium 200 g amidosulfuric acid are stirred into 400 ml deionized water in a reflux apparatus with water bath, 120 ml ammonia are added and the mixture is then heated to 50° C. 50 g ruthenium in the form of ruthenium(III) chloride hydrate are added and the solution boiled 4 hours on reflux. After filtration through filters with 1 $\mu$m pore width the solution is filled up to 1 liter final volume.

Galvanic bath

Parts of the charge concentrate are diluted to a content of 5 g/l ruthenium and adjusted to a pH of 1.5. The addition of compounds of formula I in a content of 2 g/l then takes place.

EXAMPLE 2

Galvanic layer deposition and comparative measuring of the inner stress:

Electrolyte 1

Ruthenium nitridochloro complex (RuNC) according to U.S. Pat. No. 3,576,724.

| | |
|---|---|
| Ruthenium (as ruthenium(III) chloride hydrate) | 25 g |
| Amidosulfonic acid | 150 g |
| Deionized water | 400 ml. |

The solution is boiled 4 hours on reflux and filled up, after having cooled off to room temperature, to 500 ml. This concentrate with 50 g/l Ru is diluted with deionized water to the application concentration of 5 g/l Ru.

Electrolyte 2

$Ru_2N(OH)_5$ according to DE-OS 22 61 944

Ruthenium nitridochloro complex (electrolyte 1) 21.1 g (corresp. to 7.2 g Ru)

| | |
|---|---|
| deionized water | 300 ml |

The solution is heated to 90° C. and compounded with potassium lye (400 g/l KOH) until a pH of 9.5 is reached. The precipitate is filtered off, washed halogen-free and taken up in a mixture of 300 ml deionized water and 6 ml conc. sulfuric acid. After having been boiled on reflux for 2 hours the mixture is filled up with deionized water to 500 ml. Then, 100 g ammonium sulfate, 10 g ammonium sulfamate and ammonia are added until a pH of 1.5 is reached. After analysis, the mixture is diluted with deionized water to the recommended application concentration of 10 g/l Ru.

Electrolyte 3

RuNC electrolyte with oxalic acid according to EP 0,018,165

| | |
|---|---|
| RuNC complex (electrolyte 1) | 5 g Ru |
| Oxalic acid dihydrate | 80 g |

Dissolve in 1 liter deionized water and add potassium lye until a pH of 7.5–8 is achieved. The solution is then left for 1 hour at approximately 95° C.

Electrolyte 4

RuNC+indium according to DE-OS 20 14 122

| | |
|---|---|
| RuNC | 5 g/l Ru |
| Indium (as sulfate) | 5 g/l In. |

Electrolyte 5: (in accordance with example 1 of the invention)

RuNC with 5 g/l Ru+2 g/l pyridinium-N-propyl-sulfobetain (Ib).

Electrolyte 6: (in accordance with example 1 of the invention)

RuNC with 5 g/l Ru +2 g/l pyridinium-N-(2-hydroxy)-propyl-sulfobetain (Ic).

The following table 1 shows the deposition conditions and the measured inner stresses for the layers obtained from the tested electrolytes of the invention and from known electrolytes.

TABLE 1

| | Electrolyte 1 | Electrolyte 2 | Electrolyte 3 | Electrolyte 4 | Electrolyte 5 | Electrolyte 6 |
|---|---|---|---|---|---|---|
| Ru concentration g/l | 5 | 10 | 5 | 5 | 5 | 5 |
| pH | 1.5–1.7 | 1.5–1.7 | 7.5–8.0 | 1.5 | 1.5–1.7 | 1.5–1.7 |
| Temperature ° C. | 70 | 70 | 70 | 70 | 70 | 70 |
| Current density A/dm$^2$ | 1 | 1 | 1 | 1 | 1 | 1 |
| Current yield % | 70 | 37 | 28 | 78 | 68 | 69 |
| Layer thickness μm | 1.0 | 0.7 | 0.25 | 1.0 | 1.0 | 1.0 |
| Inner stress N/mm$^2$ | 489 | −40 | 512 | 319 | 250 | 252 |

It turns out that layers with inner stresses of only approximately 250 N/mm$^2$ are obtained with the electrolytes (5 and 6) in accordance with the invention with excellent current yields. In contrast thereto known electrolytes yield layers with very high inner stresses with either very good (1) or insufficient (3) current yield or with high compressive stress and also insufficient current yield (2).

The electrolyte described and claimed herein containing pyridine or the N-alkylated pyridinium salt can be prepared as a ready to use mixed electrolyte or as a concentrate to be diluted before use. The pyridinium salt compounds can be liquid or solid, depending upon the nature of the substituent.

Further variations and modifications of the foregoing will be apparent to those skilled in the art and are intended to be encompassed by the claims appended hereto.

German priority application 197 41 990.9 is relied on and incorporated herein by reference.

We claim:

1. An electrolyte for the galvanic deposition of stress-relieved, crack-resistant ruthenium layers on an object, said electrolyte containing ruthenium in a form complexed with amidosulfuric acid, wherein said electrolyte contains as an additive pyridine or an N-alkylated pyridinium salt represented by the structural formula I (I)

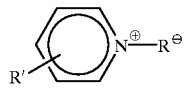

wherein $R^{\ominus}$ is a member selected from the group consisting of $—(CH_2)_3—SO_3^{\ominus}$, $—CH_2—CHOH—CH_2—CH_2—SO_3^{\ominus}$, and

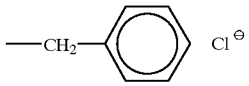

and R' is a member selected from the group consisting of H, alkyl with 1–6 C atoms, $—CH{=}CH_2$, and $—CO_2Na$.

2. The electrolyte according to claim 1, wherein said salt is a member selected from the group consisting of 1-benzyl-3-sodium carboxypyridinium chloride, pyridinium-N-propyl-sulfobetain, pyridinium-N-(2-hydroxypropyl)-sulfobetain and 2-vinylpyridinium-N-propyl-sulfobetain.

3. The electrolyte according to claim 2 wherein said additive is present in an amount of 0.1 to 100 g/l.

4. The electrolyte according to claim 2 wherein said additive is present in an amount of 1 to 10 g/l.

5. The electrolyte according to claim 2 wherein ruthenium is present in an amount of 1 to 100 g/l.

6. The electrolyte according to claim 2 wherein the ruthenium is present in the form of the ruthenium nitridochloro complex $[Ru_2NCl_8(H_2O)_2)]^{3-}$.

7. The electrolyte according to claim 1 wherein said additive is present in an amount of 0.1 to 100 g/l.

8. The electrolyte according to claim 3 wherein ruthenium is present in an amount of 1 to 100 g/l.

9. The electrolyte according to claim 3 wherein the ruthenium is present in the form of the ruthenium nitridochloro complex $[Ru_2NCl_8(H_2O)_2)]^{3-}$.

10. The electrolyte according to claim 1 wherein said additive is present in an amount of 1 to 10 g/l.

11. The electrolyte according to claim 4 wherein the ruthenium is present in the form of the ruthenium nitridochloro complex $[Ru_2NCl_8(H_2O)_2)]^{3-}$.

12. The electrolyte according to claim 1 wherein ruthenium is present in an amount of 1 to 100 g/l.

13. The electrolyte according to claim 1 wherein ruthenium is present in an amount of 5 to 50 g/l.

14. The electrolyte according to claim 1 wherein the ruthenium is present in the form of the ruthenium nitridochloro complex $[Ru_2NCl_8(H_2O)_2)]^{3-}$.

15. A method of producing an electrolyte for the galvanic deposition of stress-relieved, crack-resistant ruthenium layers according to claim 1 comprising adding pyridine or a compound of formula I to an aqueous-acidic solution containing ruthenium in a form complexed with amidosulfuric acid.

16. A method of producing stress-relieved, crack-resistant ruthenium layers by galvanic deposition comprising cathodically depositing ruthenium from an electrolyte in accordance with one of claim 1.

17. The method according to claim 16 comprising carrying out the galvanic deposition at a pH of 0 to 2, at a temperature of 20 to 90° C. and with a cathode current density of 0.5 to 8 A/dm$^2$.

18. The method of using pyridine or an N-alkylated pyridinium salt of formula I (I)

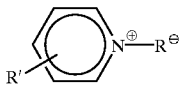

wherein $R^{\ominus}$ is a member selected from the group consisting of: $—(CH_2)_3—SO_3^{\ominus}$, $—CH_2—CHOH—CH_2—SO_3^{\ominus}$, and

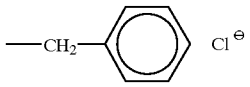

and R' is a member selected from the group consisting of H, alkyl with 1–6 C atoms, $—CH{=}CH_2$, and $—CO_2Na$ as an additive in an electrolyte containing ruthenium in a form complexed with amidosulfuric acid for the galvanic deposition of stress-relieved, crack-resistant ruthenium layers comprising adding said additive to the electrolyte or to ingredients used to prepare the electrolyte.

* * * * *